US007791498B2

(12) United States Patent
Park

(10) Patent No.: US 7,791,498 B2
(45) Date of Patent: Sep. 7, 2010

(54) APPARATUS AND METHOD FOR DRIVING LED

(75) Inventor: Seong Soo Park, Gwangju (KR)

(73) Assignee: LG Innotek Co., Ltd., Seoul (KR)

( * ) Notice: Subject to any disclaimer, the term of this patent is extended or adjusted under 35 U.S.C. 154(b) by 769 days.

(21) Appl. No.: 11/651,459

(22) Filed: Jan. 10, 2007

(65) Prior Publication Data

US 2007/0159472 A1 Jul. 12, 2007

(30) Foreign Application Priority Data

Jan. 11, 2006 (KR) ..... 10-2006-0003074

(51) Int. Cl.
*G09G 3/32* (2006.01)

(52) U.S. Cl. ..... 340/815.45; 340/815.4; 340/635; 340/944; 345/39; 345/47; 345/82; 257/13; 257/79; 257/103; 257/918; 250/552; 250/553

(58) Field of Classification Search ..... 340/815.45, 340/815.4, 635, 944; 345/39, 47, 82, 99, 345/204; 353/20, 94; 315/312; 359/237; 362/611, 612, 613; 250/552; 257/13, 79, 257/103, 918

See application file for complete search history.

(56) References Cited

U.S. PATENT DOCUMENTS

| | | | | |
|---|---|---|---|---|
| 6,726,329 | B2 * | 4/2004 | Li et al. | 353/20 |
| 6,903,716 | B2 * | 6/2005 | Kawabe et al. | 345/99 |
| 2002/0063854 | A1 * | 5/2002 | Flint | 353/94 |
| 2005/0088119 | A1 * | 4/2005 | Potucek et al. | 315/312 |
| 2005/0117190 | A1 * | 6/2005 | Iwauchi et al. | 359/237 |
| 2005/0259439 | A1 * | 11/2005 | Cull et al. | 362/612 |
| 2009/0016076 | A1 * | 1/2009 | Overes et al. | 362/612 |

FOREIGN PATENT DOCUMENTS

KR 1020050112952 A 12/2005

* cited by examiner

*Primary Examiner*—George A Bugg
*Assistant Examiner*—Sisay Yacob
(74) *Attorney, Agent, or Firm*—Birch, Stewart, Kolasch & Birch, LLP

(57) ABSTRACT

Provided are an apparatus and method for driving LEDs. The apparatus comprise a plurality of red, green, and blue light emitting diodes connected, respectively; switching units turned on or off by an inputted pulse to turn on or off the red, green and blue light emitting diodes, respectively; and a control unit outputting respective pulses to sequentially delay a turn-on or turn-off time between the switching units.

20 Claims, 3 Drawing Sheets

APPARATUS AND METHOD FOR DRIVING LED

BACKGROUND OF THE INVENTION

1. Field of the Invention

The present invention relates to an apparatus and method for driving a light emitting diode (LED).

2. Description of the Related Art

LEDs are widely used as a light source of a backlight unit in a liquid crystal display (LCD) device to enhance a color reproduction and a high brightness.

The backlight unit includes an edge type and a direct type according to a method of using a light source. In the edge type, a light source is installed on a side of a light guiding plate. The edge type is applied to a relatively small sized LCD device such as a computer monitor. The direct type is applied to a relatively large sized LCD device such as larger than a 20 inch monitor.

The backlight unit includes a plurality of arrays for lights of red, green, and blue LEDs. Driving pulses are supplied into red LED, green LED, and blue LED, respectively. A white light including red, green, and blue lights is used as a light source.

As illustrated in FIG. 1, the driving pulse is outputted to each LED at the same predetermined interval T. Therefore, the red, green, and blue LEDs are simultaneously turned on or off. However, all the LEDs in the backlight unit are turned off or on simultaneously. Accordingly, numerous compound harmonics occur such that wave noise in an output screen of an LCD panel of FIG. 2 is generated. The wave noise distorts an image in the LCD panel.

SUMMARY OF THE INVENTION

Accordingly, the present invention is directed to an apparatus and method for driving LEDs that substantially obviates one or more problems due to limitations and disadvantages of the related art.

The embodiment of the present invention provides an apparatus and method for driving LEDs for reducing wave noise, which is caused by the LEDs, by sequentially turning on or off the LEDs that emits three colors.

The embodiment of the invention provides an apparatus for driving a light emitting diode comprising: a plurality of red, green, and blue light emitting diodes connected respectively; switching units turned on or off by an inputted pulse to turn on or off the red, green and blue light emitting diodes, respectively; and a control unit outputting respective pulses to sequentially delay a turn-on or turn-off time between the switching units.

The embodiment of the invention provides a method for driving a light emitting diode, the method comprising: outputting pulses respectively to sequentially delay a turn-on or turn-off time of switching units; sequentially turning on or off the switching units to turn on or off red, green, blue light emitting diodes electrically connected to the switching units, respectively.

The embodiment of the invention provides a method for driving a light emitting diode, the method comprising: detecting a state of a pulse; sequentially delaying a turn-on time of switching units to sequentially turn on red, green, and blue light emitting diodes when the pulse is changed in a first state; and sequentially delaying a turn-off time of switching units to sequentially turn off red, green, and blue light emitting diodes when the pulse is changed in a second state.

According to the present invention, wave noise can be reduced in a combined light by sequentially turning on or off LEDs emitting three colors.

It is to be understood that both the foregoing general description and the following detailed description of the present invention are exemplary and explanatory and are intended to provide further explanation of the invention as claimed.

DETAILED DESCRIPTION OF THE INVENTION

Reference will now be made in detail to the preferred embodiments of the present invention, examples of which are illustrated in the accompanying drawings.

Figure 1:
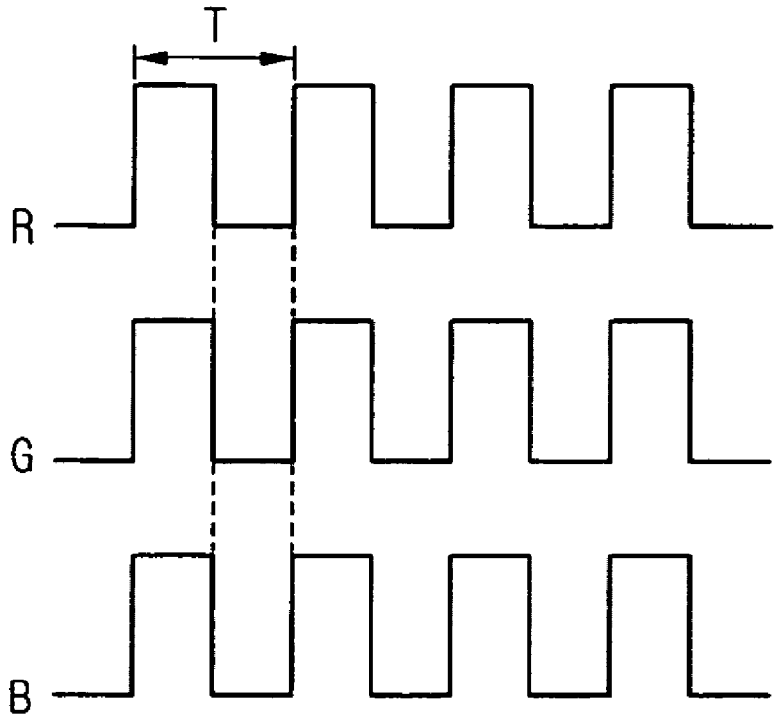
FIG. 1 is a view of pulses supplied to related art red, green, and blue LEDs.
Figure 2:
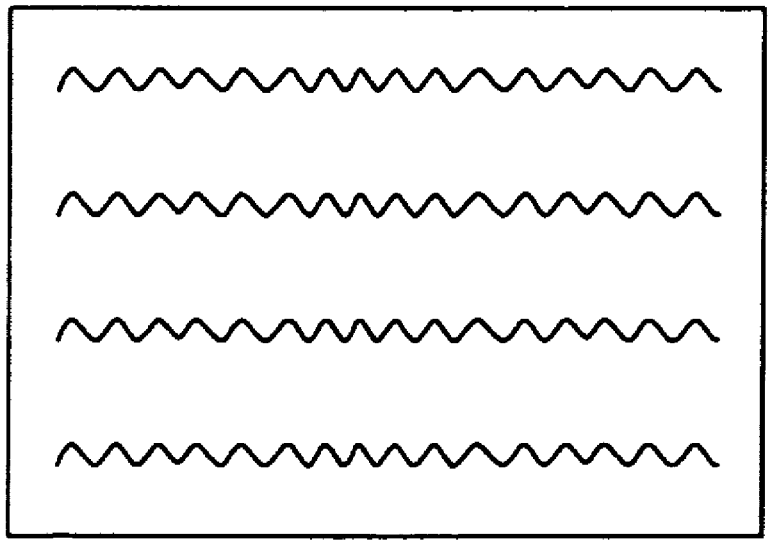
FIG. 2 is a view of wave noise generated by the LEDs of FIG. 1.
Figure 3:
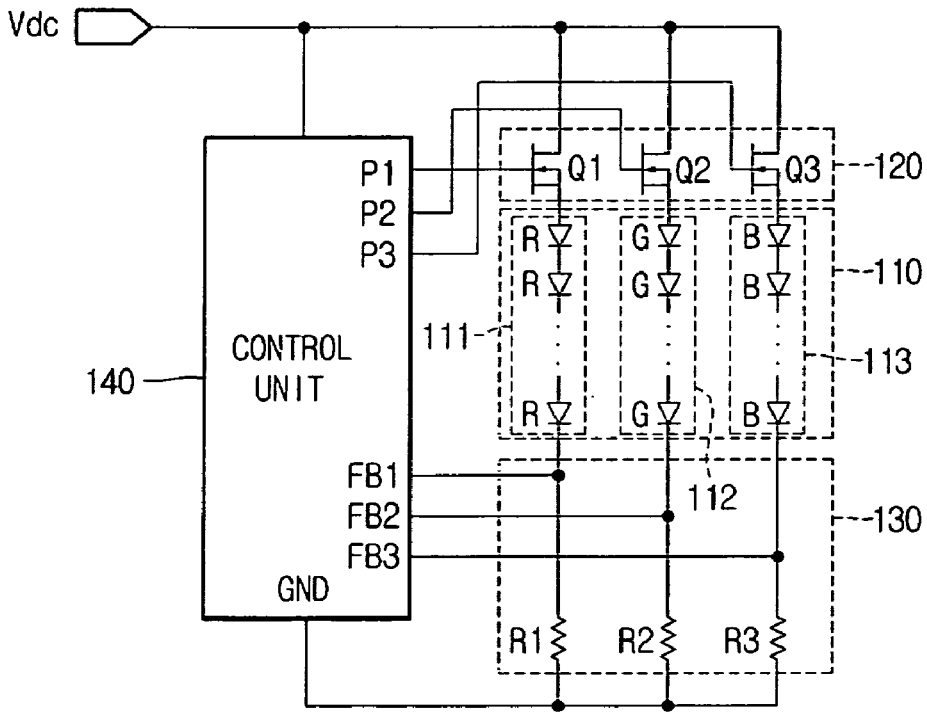
FIG. 3 is a view of an LED driving unit according to an embodiment of the present invention.

FIG. 3 is a view of an LED driving unit according to an embodiment of the present invention.

Referring to FIG. 3, the LED driving unit includes a light emitting unit 110, a switching unit 120, a feedback unit 130, and a control unit 140.

The light emitting unit 110 includes red, green, and blue LEDs 111, 112, and 113 to provide a white light. In the red LED 111, a plurality of red LED chips are connected in serial to each other. In the green LED 112, a plurality of green LED chips are connected in serial to each other. In the blue LED 113, a plurality of blue LED chips are connected in serial to each other.

Here, one of the red LED chips, one of the green LED chips, and one of the blue LED chips constitute a cluster in a package. A plurality of clusters are disposed to form one module. Additionally, a plurality of modules are connected to form one LED bar. The backlight unit of a related art medium or large sized LED panel uses a plurality of LED bars.

The light emitting unit 110 is turned off or on by the switching unit 120.

The switching unit 120 includes a plurality of switching elements Q1, Q2, and Q3 formed of a metal oxide semiconductor field effect transistor (MOSFET). A drain terminal of each of the switching elements Q1, Q2, and Q3 is commonly connected to a current power source terminal Vdc. A gate terminal is connected to pulse output terminals P1, P2, and P3 of the control unit 140. Additionally, a source terminal of each of the switching elements Q1, Q2, and Q3 is connected to anode terminals of the first red LED, the first green LED, and the first blue LED. Resistors R1, R2, and R3 of the feedback unit 130 are connected to cathode terminals of the last LEDs.

The feedback unit 130 includes resistors R1, R2, and R3 connected to the cathode of the last LEDs, respectively. A voltage applied to the resistors R1, R2, and R3 is applied to feedback terminals FB1, FB2, and FB3 of the control unit 140.

The control unit 140 outputs pulse signals through pulse output terminals P1, P2, and P3 to turn on or off the switching elements Q1, Q2, and Q3 of the switching unit 120, and thus the LEDs 111, 112, and 113 can be turned on or off by turning on or off the switching elements Q1, Q2, and Q3.

At this point, the control unit 140 adjusts a duty ratio of a pulse to control a turn-on or turn-off period. This normally maintains a high color reproduction and a brightness uniformity, and also adjusts an entire brightness through overall dimming of RGB.

The control unit 140 delays a pulse in each of the switching elements Q1, Q2, and Q3 by a predetermined interval. For example, the second switching element Q2 is delayed by a predetermined interval compared to the first switching element Q1. The third switching element Q3 is delayed by a predetermined interval compared to the second switching element Q2.

At this point, since the pulses are delayed by a predetermined interval and then inputted, the three switching elements Q1, Q2, and Q3 are not simultaneously turned on or off, and are turned on or off in a delayed interval. Moreover, the red LED 111, green LED 112, and blue LED 113 connected to switching elements Q1, Q2, and Q3 are not simultaneously turned on or off, and are turned on or off in a delayed interval. Because of a delayed operation in each of the red LED 111, the green LED 112, and the blue LED 113, wave noise due to an impulse noise between colors can be prevented.

Here, the pulses can be inputted into the three switching elements Q1, Q2, and Q3 at the same interval. For example, the second switching element Q2 receives a pulse that is delayed by 140 μs and the third switching element Q3 receives a pulse delayed by 140*2 μs by using a starting point of the first switching element Q1 as a reference. At this point, the pulse delaying time is in a sequential order of the first switching element Q1 through the third switching element Q3. The sequential order can be in a reverse order. Moreover, the pulse inputted into the third switching element Q3 is delayed using a starting point of the second switching element Q2 as a reference.

The control unit 140 receives feedbacks from a feedback unit 130. The feedbacks include operation times of the red LED 111, the green LED 112, the blue LED 113 in the light emitting unit 110, respectively. Then, the control unit 140 stores the feedbacks. After a predetermined delay time, the control unit 140 controls an operation of the next switching element.

Here, the control unit 140 outputs a driving pulse into the next switching element. The driving pulse is constantly delayed from a starting point of a previously operating switching element or a changing point of an LED operation.

The control unit 140 controls an ascending or descending edge of a pulse as an operation starting point, and delays another pulse by a predetermined period based on the turning on or off of the three color LEDs 111, 112, and 113 as a reference. The synchronization time of the three color LEDs is reduced through a periodic delay of the three color LEDs. Consequently, wave noise can be prevented.

Figure 4:
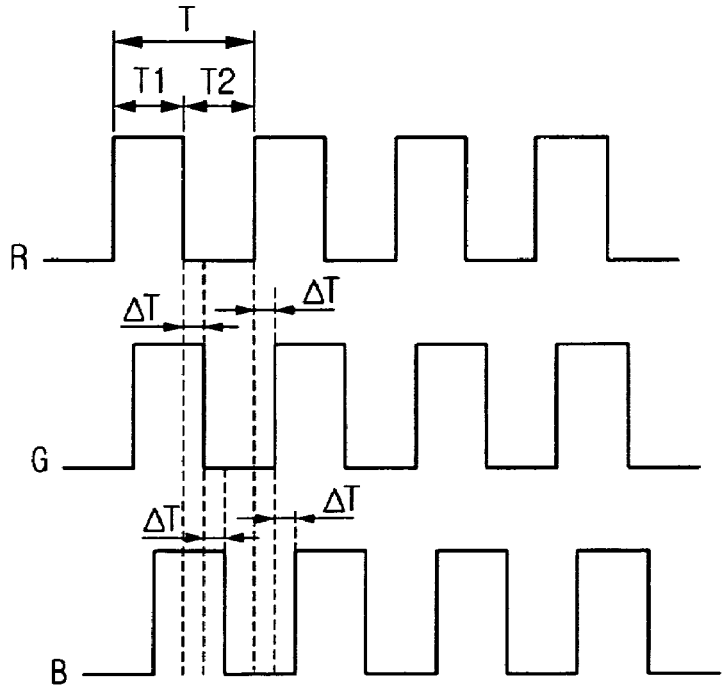
FIG. 4 is a view of driving pulses of LEDs according to an embodiment of the present invention.

FIG. 4 is a view of driving pulses of LEDs according to an embodiment of the present invention.

Referring to FIGS. 3 and 4, each of the switching elements Q1, Q2, and Q3 is turned off at a descending edge of a pulse, and is turned on at an ascending edge of a pulse.

The first switching element Q1 performs a periodic operation by a period T including a turn-on time T1 and a turn-off time T2 in an R pulse.

The second switching element Q2 performs a turn-on or a turn-off periodically by a period including a turn-on time and a turn-off time in a G pulse. The turn-off point is delayed by a delay time ΔT compared to the turn-off point of the R pulse.

The third switching element Q3 performs a turn-on or a turn-off periodically by a period including a turn-on time and a turn-off time in a B pulse. The turn-off point is delayed by a delay time ΔT compared to the turn-off point of the G pulse inputted into the second switching element Q2. The turn-on point is delayed by a delay time ΔT compared to the turn-on point of the G pulse inputted into the second switching element Q2.

The three switching elements Q1, Q2, and Q3 are not turned on or off simultaneously, and turned on or off by a predetermined delay time ΔT. The turn-on or turn-off starting point of the red, green, and blue LEDs 111, 112, and 113 is delayed by the delay time ΔT through the turn-on or turn-off operation in each of the switching elements Q1, Q2, and Q3.

Figure 5:
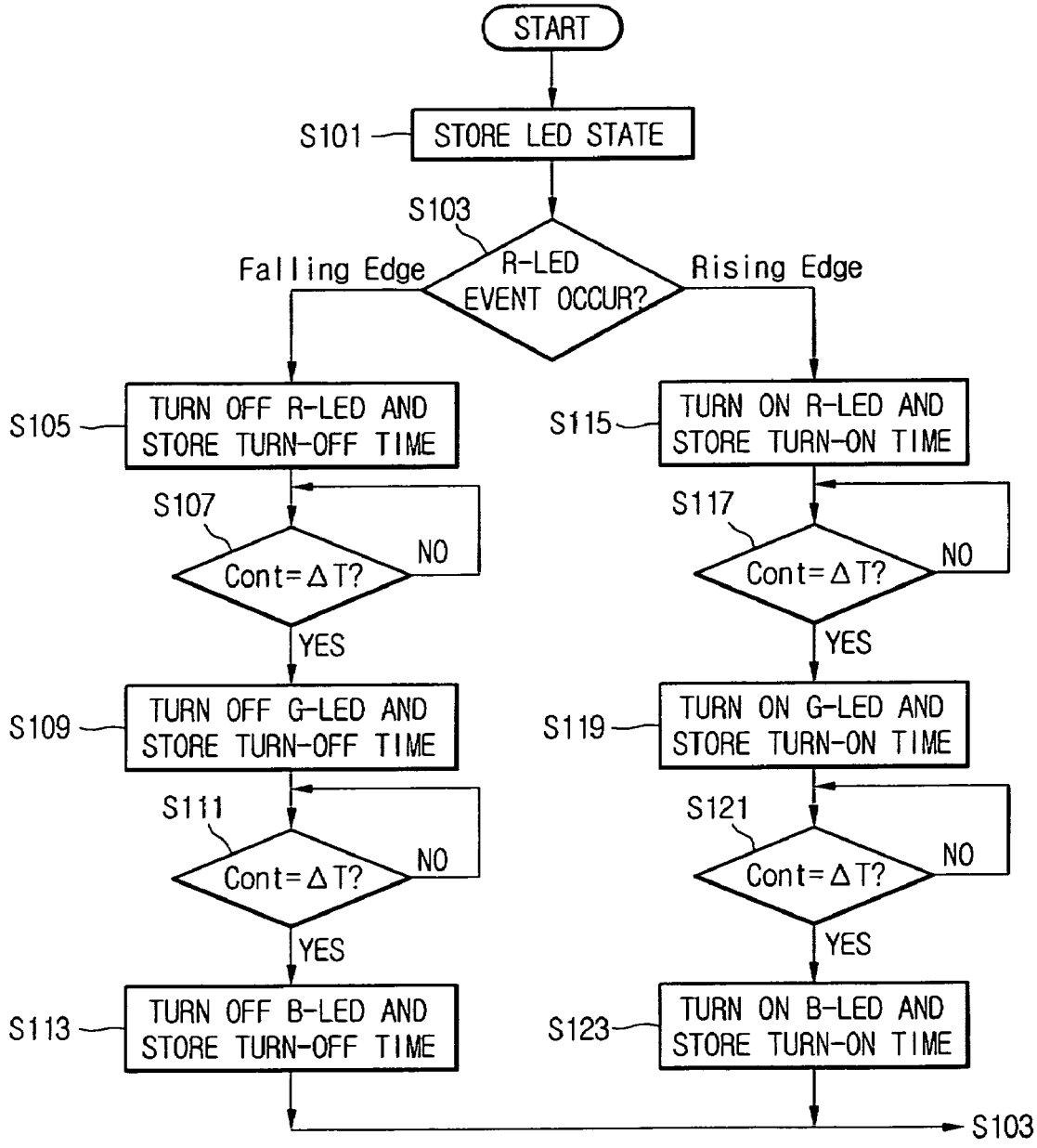
FIG. 5 is a flowchart illustrating a method for driving LEDs according to an embodiment of the present invention.

FIG. 5 is a flowchart illustrating a method for driving LEDs according to an embodiment of the present invention. The present invention exemplifies the sequentially delayed RGB LEDs, but is not limited to the sequential order.

Referring to FIG. 5, states of the LEDs are stored in operation S101, and it is confirmed whether an event of a pulse signal corresponding to a red LED occurs or not in operation S103.

When the pulse for the red LED is an event of a falling edge, the red LED is turned off and the turn-off time is stored in a register in operation S105. When a clock counted from the turn-off time of the red LED is identical to a predetermined time (Count=ΔT) in operation S107, the green LED is turned off, and the turn-off time is stored in a register in operation S109.

Here, a predetermined delay time is calculated by counting a clock from the turn-off time of the red LED.

When the clock counted from the turn-off time of the green LED is identical to the predetermined delay time (Count=ΔT), the blue LED is tuned off. Then, the turn-off time of the blue LED is stored in a register in operation S113. At this point, the turn-off time of the blue LED (i.e., the last LED) may not be stored.

Moreover, when the event of operation S103 is for an ascending edge of a pulse, the red LED is turned on and the turn-on time is stored in a register in operation S115. A clock is counted from the turn-on time of the red LED. When the clock counted from the turn-on time of the red LED is identical to a predetermined time (Count=ΔT) in operation S117, the green LED is turned on, and the turn-on time is stored in a register in operation S119.

A clock is counted from the turn-on time of the green LED. When the clock counted from the turn-on time of the green LED is identical to a predetermined time (Count=ΔT) in operation S121, the blue LED is turned on, and the turn-on time is stored in a register in operation S123. Here, the turn-on time of the blue LED, that is, the turn-on time of the last LED may not be stored.

After the blue LED is turned on or off, it is confirmed whether an ascending edge or descending edge event of a pulse occurs or not in operation S103. This will repeat periodically.

Likewise, a predetermined time is delayed by using the shift point as a reference, where the shift point is from the turn-on to the turn-off or from the turn-off to the turn-on in the first switching element. Then, the state of the second switching element is changed. Moreover, since according to a shift in each of the switching elements, the turn-on or off starting operation of a corresponding LED is delayed, wave noise can be minimized by the delay between the three color LEDs.

The LED driving device of the present invention sequentially controls the LEDs in the backlight unit of a large sized liquid crystal panel, and minimizes wave noise in the liquid crystal panel.

Additionally, when the LEDs are mounted on the direct type backlight unit, a plurality of LED bars can be disposed. The same delay time (e.g., 148 μs (microsecond)) is used to control the LED bars. That is, the delay of the LED bars connected in parallel besides the delay of the three color LEDs can be performed simultaneously. For example, when there are seven LED bars, total 27 delays (three color LEDs and seven LED bars) can be performed.

According to the present invention, since three LEDs are sequentially turned on or off, a synchronization time of three LEDs is reduced to minimize wave noise.

Moreover, the reliability of a backlight unit and a liquid crystal display device for a large sized panel can be enhanced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A light emitting diode driving device, comprising:

a plurality of red, green, and blue light emitting diodes connected, respectively;

switching units turned on or off by an inputted pulse to turn on or off the red, green and blue light emitting diodes, respectively;

a control unit outputting respective pulses to sequentially delay a turn-on or turn-off time between the switching units; and a feedback unit detecting a turn-on or turn-off time of the light emitting diode to provide the turn-on or turn-off time into the control unit, wherein the feedback unit is connected to cathode terminals of the last red, green, and blue light emitting diodes, respectively.

2. The apparatus according to claim 1, wherein the switching unit is formed of a metal oxide semiconductor field effect transistor.

3. The apparatus according to claim 1, wherein the sequential turn-on or turn-off time between the switching units is delayed at a predetermined time interval.

4. The apparatus according to claim 1, wherein the red, green, and blue LEDs respectively connected in serial are sequentially turned on or off.

5. The apparatus according to claim 1, wherein a delay time between the switching units is 148 μs.

6. The apparatus according to claim 1, wherein the feedback unit includes resistors connected to the cathode terminals of the last red, green, and blue light emitting diodes and is connected to feedback terminals of the control unit, respectively.

7. The apparatus according to claim 1, wherein the control unit stores the turn-on or turn-off time of the feedback unit, respectively to output a driving pulse of a next switching unit by counting a delay time from the time of storing.

8. The apparatus according to claim 1, wherein the turn-on or turn-off time of the switching units is delayed according to an ascending edge or a descending edge of a previously operating switching unit.

9. A method for driving a light emitting diode, the method comprising:

outputting pulses respectively to sequentially delay a turn-on or turn-off time of switching units;

sequentially turning on or off the switching units to turn on or off red, green, and blue light emitting diodes electrically connected to the switching units, respectively;

detecting a voltage respectively from cathode terminals of the last red, green, and blue emitting diodes; and controlling a duty ratio of a pulse to control a turn-on or turn-off period of the switching unit.

10. The method according to claim 9, wherein the turning on of the light emitting diode comprises:

turning on a first light emitting diode among the red, green, and blue light emitting diodes;

turning on a second light emitting diode among the red, green, and blue light emitting diodes, the second light emitting diode being delayed by a predetermined delay time from a turn-on time of the first light emitting diode; and turning on a third light emitting diode among the red, green, and blue light emitting diodes, the third light emitting diode being delayed by a predetermined delay time from a turn-on time of the second light emitting diode.

11. The method according to claim 10, wherein the first, second, and third light emitting diodes emits respectively different colors, and comprises one of red, green, and blue light emitting diodes connected in serial, respectively.

12. The method according to claim 9, wherein the turning off of the light emitting diode comprises:

turning off a first light emitting diode among the red, green, and blue light emitting diodes;

turning off a second light emitting diode among the red, green, and blue light emitting diodes, the second light emitting diode being delayed by a predetermined delay time from a turn-off time of the first light emitting diode; and turning off a third light emitting diode among the red, green, and blue light emitting diodes, the third light emitting diode being delayed by a predetermined delay time from a turn-off time of the second light emitting diode.

13. The method according to claim 12, wherein the first, second, and third light emitting diodes emits respectively different colors, and comprises one of red, green, and blue light emitting diodes connected in serial, respectively.

14. The method according to claim 9, wherein a sequential delay of the pulse is delayed by the same time interval from a starting time of a previously turned on or off light emitting diode.

15. The method according to claim 9, wherein the delay time between the pulses is 145 μs.

16. The method according to claim 9, wherein the red, green, and blue light emitting diodes are sequentially controlled.

17. A method for driving a light emitting diode, the method comprising:

detecting a voltage respectively from cathode terminals of the last red, green, and blue light emitting diodes;

detecting a state of a pulse;

sequentially delaying a turn-on time of switching units to sequentially turn on red, green, and blue light emitting diodes when the pulse is changed in a first state; and sequentially delaying a turn-off time of switching units to sequentially turn off red, green, and blue light emitting diodes when the pulse is changed in a second state.

18. The method according to claim 17, wherein the first state of the pulse changes from a low level into a high level, and the second state of the pulse changes from a high level into a low level.

19. The method according to claim 17, wherein the turn-on or turn-off time of the light emitting diode is feedback to delay a turn-on or turn-off starting time of a next switching unit.

20. The method according to claim 17, wherein the light emitting diodes are used as a light source in a direct-type backlight unit.

* * * * *